US007230384B2

(12) United States Patent
Kialashaki et al.

(10) Patent No.: US 7,230,384 B2
(45) Date of Patent: Jun. 12, 2007

(54) ROBUST RF INTERFACE IN A TWT

(75) Inventors: Farzad Kialashaki, Thousand Oaks, CA (US); Reza J. Kialashaki, Thousand Oaks, CA (US)

(73) Assignee: Whittaker Corporation, Simi Valley, CA (US)

( * ) Notice: Subject to any disclaimer, the term of this patent is extended or adjusted under 35 U.S.C. 154(b) by 113 days.

(21) Appl. No.: 11/083,186

(22) Filed: Mar. 17, 2005

(65) Prior Publication Data

US 2006/0208644 A1 Sep. 21, 2006

(51) Int. Cl.
*H01J 25/34* (2006.01)

(52) U.S. Cl. ..... 315/3.5; 315/3.6; 315/39.3; 439/578; 505/855

(58) Field of Classification Search ..... 315/3.5–3.6, 315/39.3; 505/855, 826, 853, 866; 439/578, 439/283

See application file for complete search history.

(56) References Cited

U.S. PATENT DOCUMENTS 2,843,775 A 7/1958 Yasuda
2,970,240 A * 1/1961 Iversen ..... 315/3.5
3,404,306 A 10/1968 Johnson
4,026,780 A * 5/1977 Gange ..... 204/490
4,137,482 A * 1/1979 Caryotakis et al. ..... 315/3.5
4,292,567 A 9/1981 Fritchle et al.
4,560,829 A * 12/1985 Reed et al. ..... 174/102 R
4,690,482 A * 9/1987 Chamberland et al. ..... 439/578
4,820,688 A * 4/1989 Jasper, Jr. ..... 505/200
4,846,714 A * 7/1989 Welsby et al. ..... 439/348
5,119,036 A * 6/1992 Rickards et al. ..... 324/662
5,394,119 A * 2/1995 Pleva et al. ..... 333/35

FOREIGN PATENT DOCUMENTS

JP 2005069779 * 3/2005

OTHER PUBLICATIONS

Author unknown, RF $SiO_2$ Cables, Meggitt Safety Systems Inc., [online] (specification sheet ) [retrieved on retrieved on Jan. 10, 2005]. Retrieved from the Internet: <URL: http://www.stablecable.com/literature/CA003%20-SDC%20Rev%20C%2010-2004.pdf>, pp. 1-4.

Author unknown, Meggitt Safety Systems Inc., $SiO_2$ Cable Systems [online] (brochure). [retrieved on Jan. 10, 2005]. Retrieved from the Internet: <URL: http://www.stablecable.com/literature/CA004%20%20SIO2%20Rev%201%2010-2002.pdf>, pp. 1-4.

(Continued)

*Primary Examiner*—Tho Phan
*Assistant Examiner*—Chuc Tran
(74) *Attorney, Agent, or Firm*—Knobbe Martens Olson & Bear LLP

(57) ABSTRACT

Apparatus and methods provide a robust radio frequency (RF) interface for a helix-type traveling wave tube (TWT). As a vacuum device, the RF input to the TWT and the RF output from the TWT are sealed to maintain the vacuum. The disclosed robust RF interface techniques are advantageously less prone to breakage than conventional sealing techniques. In addition, configurations of the disclosed robust RF interface techniques can further exhibit relatively good impedance matches between a TWT and an associated antenna, which can reduce insertion losses and reflection losses, thereby advantageously increasing system RF output power.

21 Claims, 5 Drawing Sheets

OTHER PUBLICATIONS

Badii, Vahid, Meggitt Safety Systems Inc., Technical Comparison SiO2 vs. PTFE, 2003 Cable Sales Meeting [online]. [retrieved on Jan. 10, 2005]. Retrieved from the Internet: <URL: http://www.stablecable.com/literature/Technical%20Comparison%20SiO2%20vs.%20PTFE.pdf>, pp. 1-13.

* cited by examiner

ROBUST RF INTERFACE IN A TWT

BACKGROUND

1. Field of the Invention

The invention generally relates to a traveling wave tube (TWT). In particular, the invention relates to sealing of a vacuum envelope of a helix TWT.

2. Description of the Related Art

A traveling wave tube (TWT), also known as a traveling wave tube amplifier (TWTA), is a vacuum electron device used for amplification of relatively high power and relatively high frequency radio frequency (RF) signals. One type of TWT uses a helix as a slow-wave structure for the RF signals.

As a vacuum electron device, an interior of a TWT is maintained at a vacuum. Electrical connections between the interior and the exterior of the device are hermetically sealed to maintain the vacuum. Conventional sealing techniques for electrically coupling to a helix of the TWT suffer from relatively many disadvantages. For example, conventional sealing techniques pass an electrical conductor through a hermetically-sealed window. These windows are fabricated from a relatively thin section of ceramic material, such as aluminum oxide (AlO) or beryllium oxide (BeO).

For relatively good RF performance, the hermetically-sealed window should be relatively thin. Making the window thin reduces the amount of insertion loss of the window due to dielectric effects, such as relatively high dielectric constants or relative permittivities and relatively high dissipation factors.

Disadvantageously, the thinness of the hermetically-sealed window compromises the structural integrity of the window. As a result, the windows are relatively easily cracked or broken due to mechanical stresses, such as the stress from insertion of a cable or other transmission line, vibration, and the like. The cracking or breaking of the window can render a TWT inoperative due to the loss of the internal vacuum environment.

SUMMARY

Embodiments advantageously provide a robust radio frequency (RF) interface for a helix-type traveling wave tube (TWT). As a vacuum device, the RF input to the TWT and the RF output from the TWT are sealed to maintain the vacuum. The disclosed robust RF interface techniques are advantageously less prone to cracking or breakage than conventional sealing techniques. In addition, the disclosed robust RF interface techniques are relatively easy to manufacture. In addition, configurations of the disclosed robust RF interface techniques can further exhibit relatively good impedance matches between a TWT and an associated antenna, which can reduce insertion losses and reflection losses, thereby advantageously increasing system RF output power.

For example, in one embodiment, the TWT includes an envelope for maintaining a hermetically-sealed environment. The envelope houses at least an electron gun, a collector, and a helix-type slow-wave structure. A rigid coaxial cable has an inner conductor, a solid conductive sheath, and a dielectric disposed between at least a portion of the inner conductor and the solid conductive sheath. For example, the dielectric can correspond to a high-temperature dielectric, such as to an inorganic mineral dielectric. Examples of high-temperature dielectrics include silicon dioxide ($SiO_2$), boron nitride, diamond, aluminum oxide, magnesium oxide, beryllia, and the like. Other suitable dielectric materials will be readily determined by one of ordinary skill in the art.

A first end of the inner conductor is electrically coupled to an end of the helix-type slow-wave structure in the envelope. A hermetically-sealed RF connector is coupled to a second end of the inner conductor and a corresponding end of the solid conductive sheath. In one embodiment, both the RF input and the RF output for the TWT use the rigid coaxial cables with hermetically-sealed RF connectors for input and output.

One embodiment corresponds to a traveling wave tube (TWT) for amplification of a radio frequency (RF) signal, where the TWT includes a first rigid coaxial cable with a first end and a second end, and the second end of the first rigid coaxial cable is coupled to a first hermetically-sealed RF connector so that the second end of the first rigid coaxial cable is hermetically-sealed. The TWT further includes a second rigid coaxial cable with a first end and a second end, and the second end of the second rigid coaxial cable is coupled to the second hermetically-sealed RF connector so that the second end of the second rigid coaxial cable is hermetically-sealed. The TWT further includes a helix-type slow-wave structure or helix with a first end and a second end. The first end of the helix is operatively coupled to an inner conductor of the first end of the first rigid coaxial cable, the second end of the helix is operatively coupled to an inner conductor of the first end of the second rigid coaxial cable. The TWT further includes an envelope that maintains a sealed environment, wherein an interior of the envelope houses at least the helix-type slow-wave structure, and wherein at least portions of sheaths for the first rigid coaxial cable and the second rigid coaxial cable are disposed outside the sealed environment of the envelope and form a hermetically seal with a surface of the envelope. For example, the first rigid coaxial cable and the second rigid coaxial cable can be brazed to the surface of the envelope to form a hermetic seal.

One embodiment corresponds to a method of forming a hermetically-sealed connection for traveling wave tube (TWT). For example, the method can include providing an envelope for the TWT, where the envelope comprises a helix-type slow wave structure, an electron gun, and at least one collector; providing a rigid coaxial cable having a first end, a second end, an inner conductor, a sheath, and an insulator, where the second end is terminated by a hermetic RF connector; operatively coupling the inner conductor of the first end of the rigid coaxial cable to an end of the helix; and joining the sheath of the rigid coaxial cable to at least a portion of the envelope to form the hermetic seal. For example, the insulator can correspond to a high-temperature dielectric. In one embodiment, the method further includes using a vacuum furnace to bake out impurities from the envelope; and holding the hermetic RF connector at a lower temperature than the temperature of the vacuum furnace while baking out the impurities.

BRIEF DESCRIPTION OF THE DRAWINGS

These drawings (not to scale) and the associated description herein are provided to illustrate embodiments and are not intended to be limiting.

DETAILED DESCRIPTION OF EMBODIMENTS

Although particular embodiments of the invention are described herein, other embodiments, including embodiments that do not provide all of the benefits and features set forth herein, will be apparent to those of ordinary skill in the art.

One embodiment provides a robust radio frequency (RF) interface for a helix-type traveling wave tube (TWT). The RF input to the TWT and the RF output from the TWT are sealed to maintain the vacuum within the TWT. The disclosed RF interface techniques are advantageously less prone to breakage than conventional sealing techniques. In addition, configurations of the disclosed robust RF interface techniques can further exhibit relatively good impedance matches between a TWT and an associated antenna, which can reduce insertion losses and reflection losses, thereby advantageously increasing system RF output power.

Figure 1A:
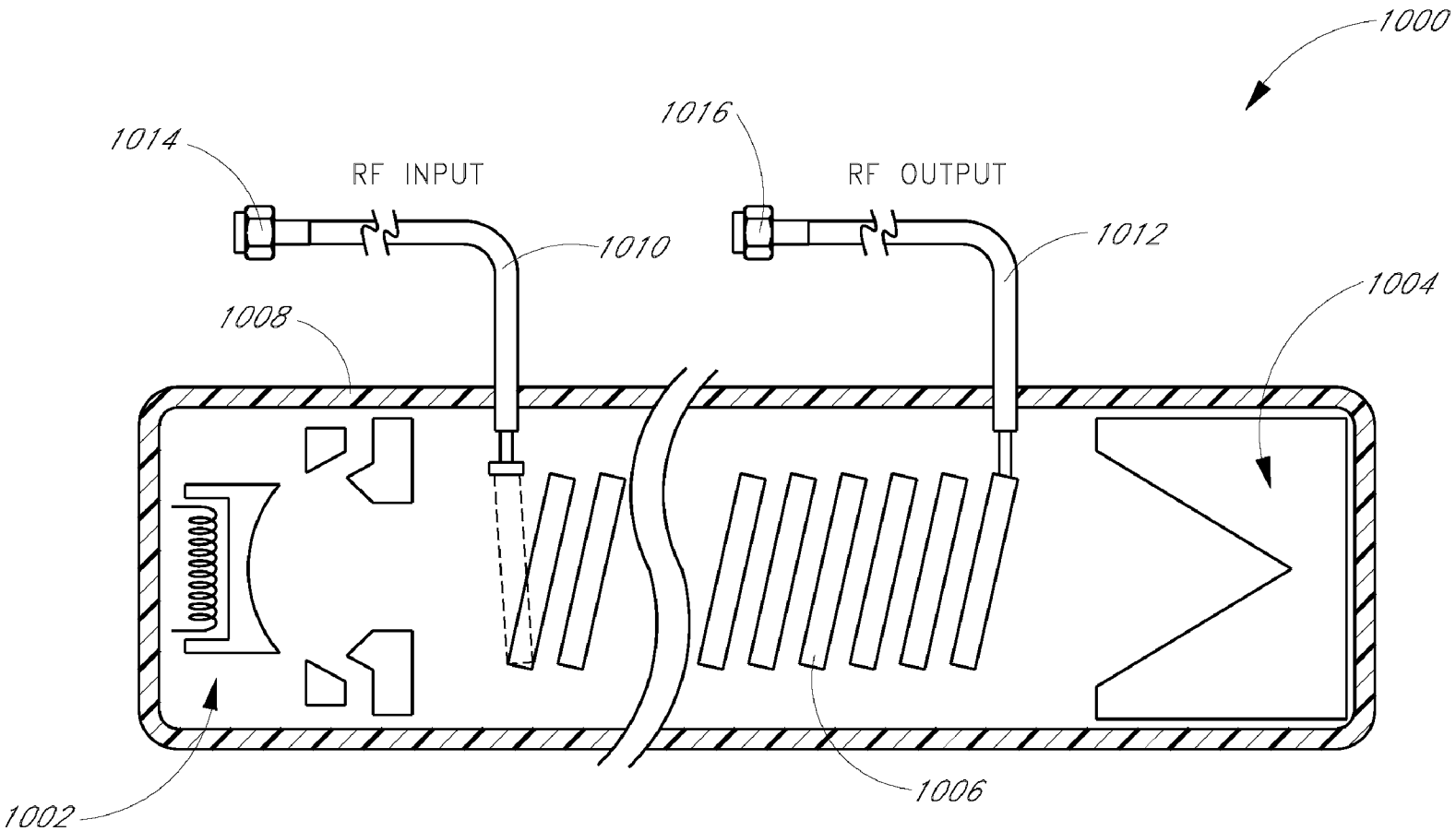
FIG. 1A is a schematic section of a traveling wave tube (TWT) according to one embodiment.

FIG. 1A is a schematic section (not to scale) of a traveling wave tube (TWT) 1000 according to one embodiment. The TWT 1000 includes an electron gun 1002, a collector 1004, and a helix slow-wave structure 1006. It will be understood that the collector 1004 can correspond to one or more collectors. The electron gun 1002 includes components such as a filament, a cathode structure, and focusing structures for generating an electron beam during operation of the TWT 1000. The emitted electron beam passes through the helix slow-wave structure 1006 and is collected by the one or more collectors 1004. The electron gun 1002, the collector 1004, and the helix slow-wave structure 1006 are typically encased in a hermetically-sealed envelope 1008, which provides a vacuum environment for the components therein.

The emitted electron beam is typically focused by a magnetic field. For example, permanent magnets, solenoids, and combinations thereof can be used to generate the magnetic field. For clarity, magnetic focusing structures for focusing of the beam are not drawn in FIG. 1A. In addition, it will be understood that the electrical power connections for the various components for the electron gun 1002 and the electrical power connections for the collector 1004 are also not shown.

An RF input signal is coupled to a first end of the helix slow-wave structure 1006 (near to the electron gun 1002). An RF output signal from the TWT 1000 is coupled to a second end of the helix slow-wave structure 1006 (near to the collector 1004). An interaction between the electron beam and the RF signals carried by the helix slow-wave structure 1006 amplifies the RF signals within the TWT 1000 during operation. It will also be understood by the skilled practitioner that many possible variations exist for helix TWTs. For example, a TWT can have a single collector or can have multiple collectors. Also see, for example, U.S. Pat. No. 2,843,775 to Yasuda, U.S. Pat. No. 3,404,306 to Johnson, U.S. Pat. No. 4,137,482 to Caryotakis, et al., and U.S. Pat. No. 4,292,567 to Fritchle, et al., the disclosures of which are hereby incorporated by reference in their entireties herein.

In a conventional helix TWT, the coupling of the RF signals to and from the helix slow-wave structure is problematic. The RF input signal originates outside the hermetically-sealed envelope 1008 and passes through the envelope 1008 to the helix slow-wave structure. The RF output signal from the helix slow-wave structure passes through the hermetically-sealed envelope 1008 to outside of the envelope 1008. U.S. Pat. No. 4,292,567 to Fritchle describes a conventional technique for passing a conductor carrying the RF signal through the envelope.

Figure 2:
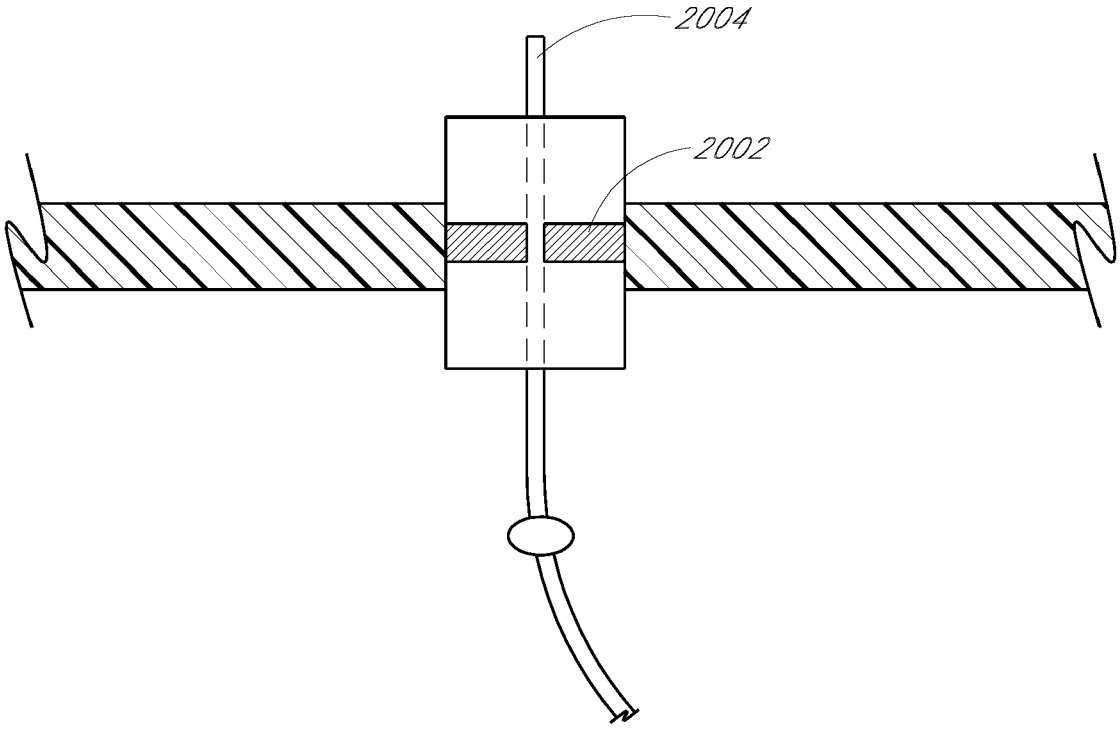
FIG. 2 (PRIOR ART)
FIG. 2 is a partial section of a prior art radio frequency (RF) interface for a helix TWT.

As illustrated in FIG. 2, in a conventional TWT, a window 2002 of a dielectric material provides hermetic sealing at the envelope. FIG. 2 is a partial section of a prior art radio frequency (RF) interface for a conventional helix TWT. For example, suitable materials such as aluminum oxide and beryllium oxide are used to form the hermetically-sealed windows. A conductor 2004 passes through the dielectric window to carry the RF signal. This approach has several drawbacks.

The dielectric materials have a relatively high dielectric constant and a relatively high dielectric loss tangent, which disadvantageously causes mismatches and losses. The losses are undesirable on the RF output of the TWT, as these losses reduce the output power of the TWT. To minimize these RF losses, the windows 2002 are kept relatively thin, such as, for example, about 20 mils to about 40 mils in thickness. However, the combination of the thinness of the window 2002 and the brittleness of the ceramic dielectric materials results in a relatively fragile window 2002. These windows 2002 are susceptible to cracking in the presence of relatively small amounts of stress, such as when subjected to the connection or removal of a transmission line, such as a coaxial cable. When cracked, a loss of hermetic sealing results, thereby ruining the TWT.

In addition, the use of the dielectric windows 2002 results in a relatively large number of interconnects. For example, there is typically a first interconnect from the conductor 2004 of the window 2002 to an end of the helix slow-wave structure, a second interconnect from the conductor 2004 of the window 2002 to a cable, and a third interconnect from the cable to a connector, all of which generate mismatches and the associated losses.

Embodiments overcome disadvantages of the conventional techniques. For example, embodiments can provide more robust RF interfaces for the TWT 1000 that eliminate the window and the associated cracking problems. Embodiments also advantageously reduce the number of electrical interconnects, thereby reducing impedance mismatches and decreasing associated losses. Advantageously, output power of the TWT 1000 can be improved over conventional techniques at a relatively low cost.

Figure 1B:
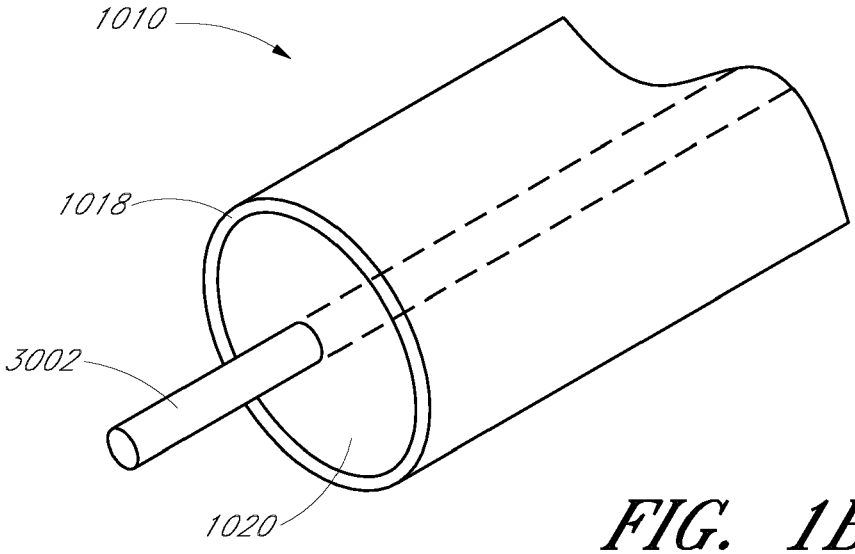
FIG. 1B is a schematic section of a rigid coaxial cable.

In one embodiment, the TWT 1000 includes one or more rigid coaxial cables 1010, 1012 for RF coupling to the helix slow-wave structure 1006. One or more rigid coaxial cables 1010, 1012 can be used for electrical connection for the RF input, for the RF output, or for both the RF input and the RF output as illustrated in FIG. 1A. The rigid coaxial cables 1010, 1012 each include an inner conductor 3002, a solid conductive sheath 1018, and a dielectric (insulator) 1020 disposed between the inner conductor 3002 and the solid conductive sheath 1018, as illustrated in FIG. 1B. A wide variety of conductive materials, such as copper, can be used for the inner conductor. A wide variety of materials can also be used for the solid conductive sheath. Examples of suitable materials include copper, stainless steel, copper-coated stainless steel, and the like. Examples of suitable materials for the dielectric include silicon dioxide ($SiO_2$), boron nitride, diamond, aluminum oxide, magnesium oxide, beryllia, and the like. For example, suitable mineral-insulated coaxial cables are available from Meggitt Safety Systems, Inc.

In the illustrated embodiment, first ends of the inner conductors of the rigid coaxial cables 1010, 1012 are coupled to the helix slow-wave structure. For example, the inner conductor and the helix slow-wave structure can be joined by welding. Other joining or wire termination techniques, such as brazing, ultrasonic welding, crimping, and the like, can also be used. It will be understood that the selected joining technique should be compatible with the relatively high temperature bake out process used during manufacture of the TWT 1000.

The solid conductive sheaths form a seal with the envelope 1008. For example, the sheaths can be brazed or the sheathes can be welded to the envelope 1008 for sealing. It will be understood that the materials selected the sealing of the sheaths should also be compatible with the relatively high temperatures used during bake out processes, which are used to drive out impurities. Further examples of forming a seal with the rigid coaxial cables 1010, 1012 and the envelope 1008 will be described in greater detail later in connection with FIGS. 3 and 4.

Figure 5:
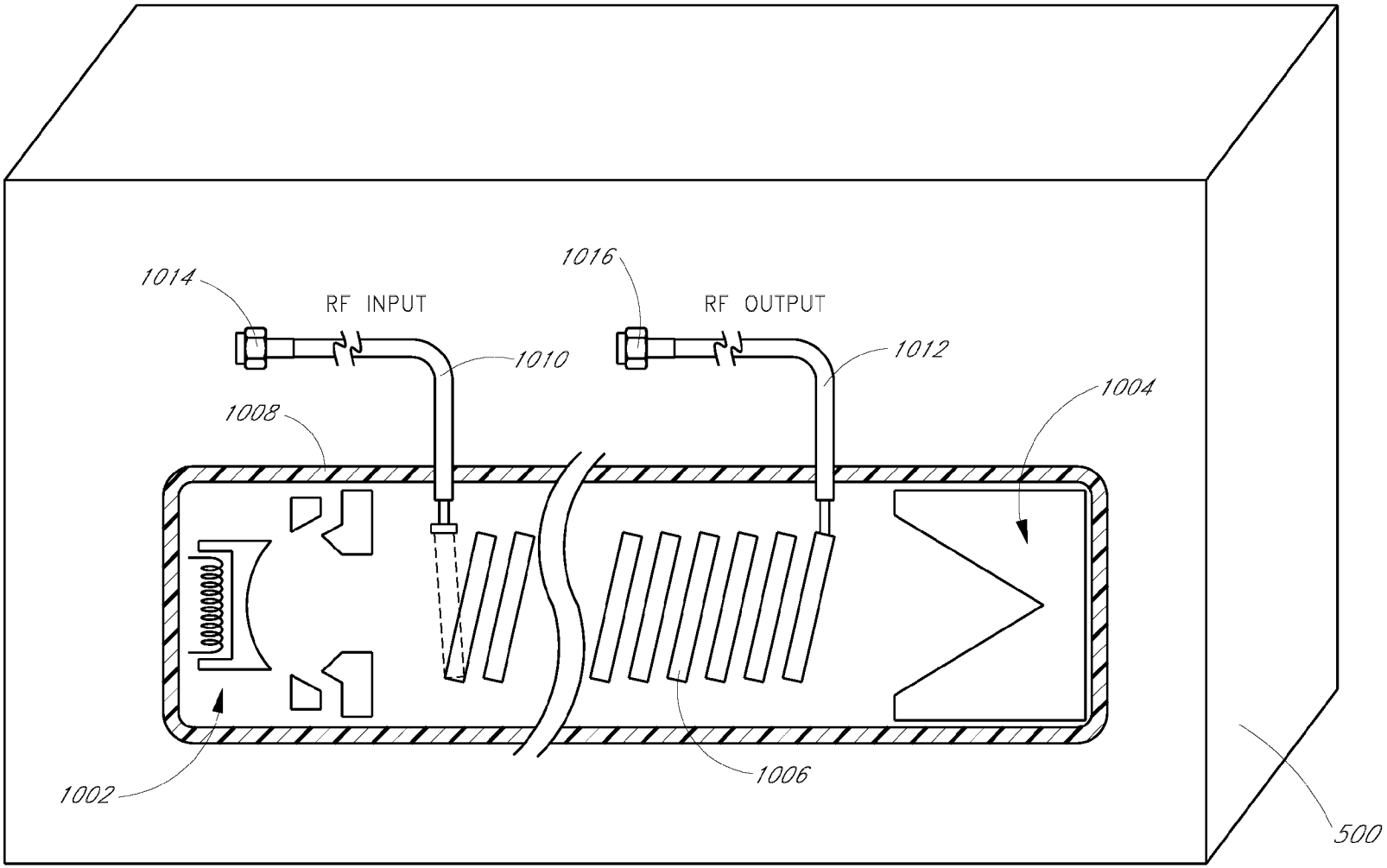
FIG. 5 is a schematic illustrating a traveling wave tube (TWT) in a vacuum furnace.

The opposite ends of the rigid coaxial cables 1010, 1012 are coupled to hermetically-sealed coaxial cable connectors. These hermetically-sealed connectors 1014, 1016 are advantageously relatively robust and less prone to cracking than the windows 2002 used in conventional TWTs. A wide variety of hermetically-sealed RF connectors can be used. The hermitically-sealed RF connectors can correspond to, but are not limited to, hermetic subminiature A (SMA) connectors, hermetic TNC connectors, hermetic SC connectors, and hermetic N connectors. Other hermetic connectors will be readily determined by one of ordinary skill in the art. In addition, it should be noted that the hermetically-sealed connectors 1014, 1016 should be maintained at a relatively low temperature during a TWT bake out process. In one example, a TWT bake out process uses a temperature of about 1200 degrees Fahrenheit (F). In one embodiment, the hermetically-sealed connectors 1014, 1016 are maintained at a temperature below about 500 degrees F. during the bake out process. For example, the hermetically-sealed connectors 1014, 1016 can be routed outside of a temperature chamber or oven and can be coupled to heatsinks to keep the temperature below about 500 degrees. In one embodiment, as illustrated in FIG. 5, a vacuum furnace 500 is used to bake out impurities from the envelope 1008, and the hermetic RF connector is held at a lower temperature than the temperature of the vacuum furnace 500 while baking out the impurities.

Figure 3:
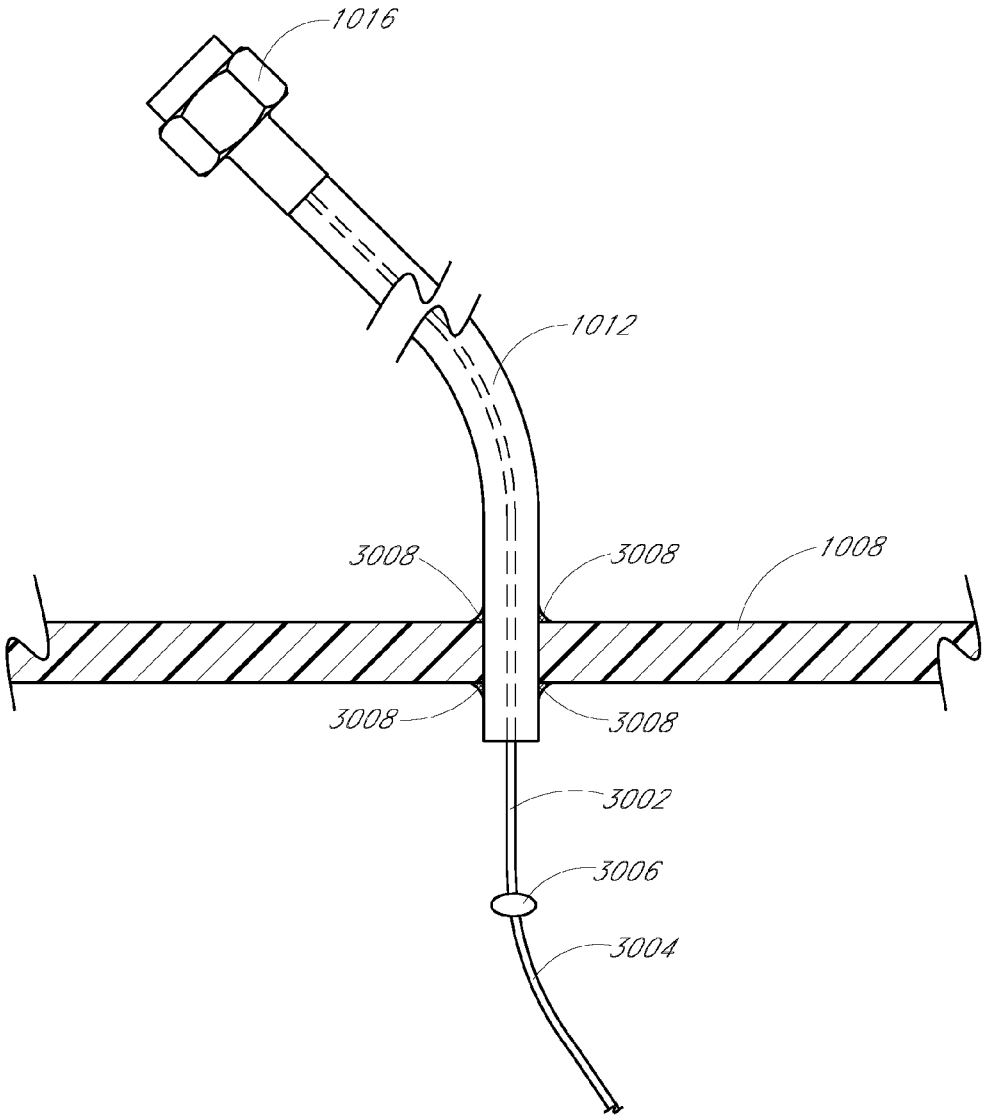
FIG. 3 is a partial section of an RF interface for a helix TWT according to one embodiment.

FIG. 3 is a partial section of an RF interface for a helix TWT according to one embodiment. An inner conductor 3002 of the rigid coaxial cable 1012 is coupled to an end 3004 of the helix slow-wave structure. FIG. 3 illustrates a weld bead 3006 joining the inner conductor 3002 and the end 3004 of the helix slow-wave structure.

The outer sheath of the rigid coaxial cable 1012 is brazed or welded to the envelope 1008 as shown by beads 3008. The beads 3008 can be formed on the inside of the envelope, formed on the outside of the envelope, formed between the sheath and the envelope, or any combination of the foregoing. The beads 3008 seal the envelope 1008 at the point that the rigid cable passes through the envelope 1008.

Figure 4:
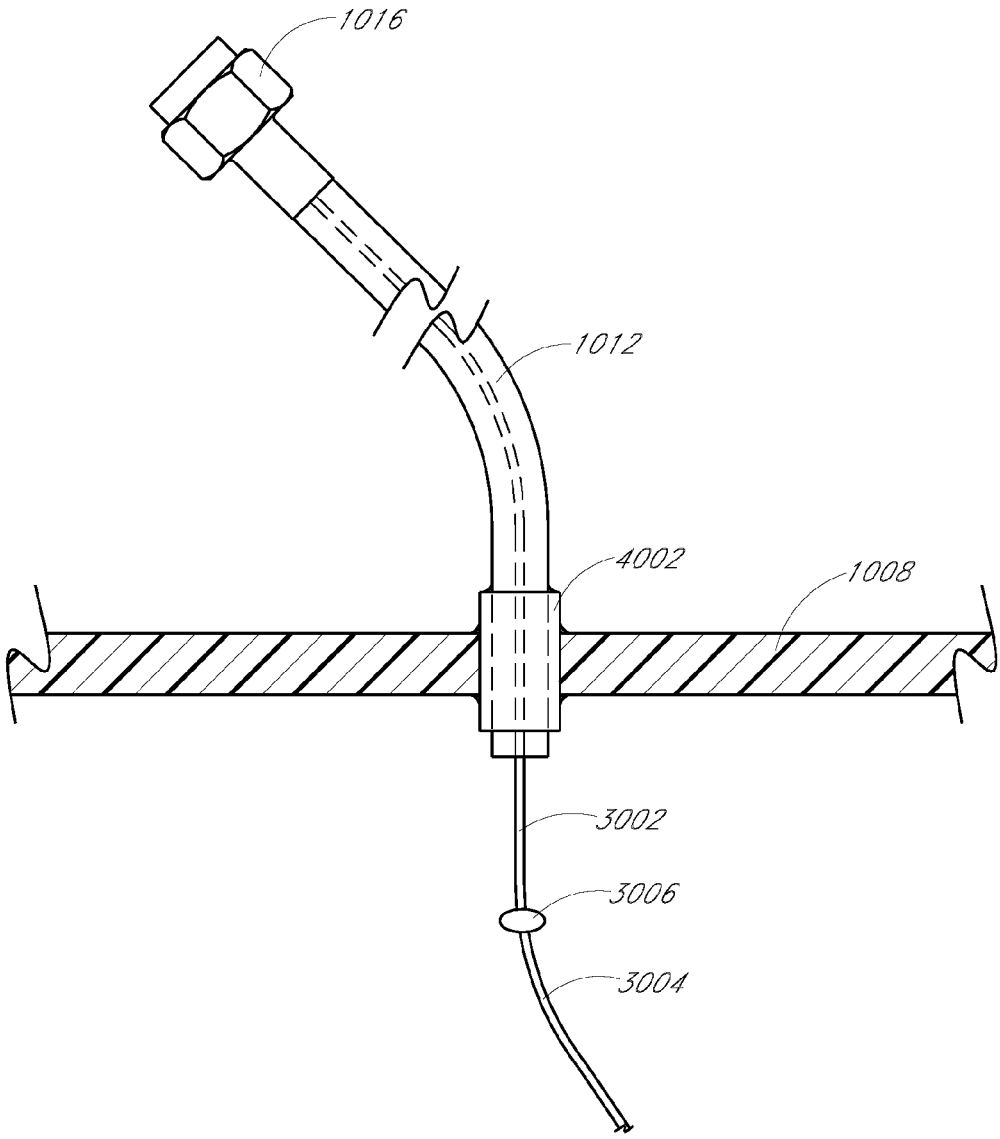
FIG. 4 is a partial section of an RF interface for a helix TWT according to one embodiment.

FIG. 4 is a partial section of an RF interface for a helix TWT according to another embodiment. In the illustrated embodiment, the envelope 1008 includes a bushing 4002 through which the rigid coaxial cable 1012 passes. This can provide additional mechanical support for the rigid coaxial cable 1012. The bushing 4002 can be sealed to the envelope 1008 and sealed to the rigid coaxial cable 1012 by brazing techniques, by welding techniques, and combinations thereof. A wide variety of other interface techniques and other mechanical supports will be readily determined by one of ordinary skill in the art.

Advantageously, the disclosed techniques can be used to provide a relatively robust interface to helix-type of TWT that is less susceptible to cracking than conventional windows. In addition, embodiments can also exhibit fewer electrical interconnects. For example, the coupling of an end of a helix slow-wave structure to the inner conductor of a rigid coaxial cable can advantageously eliminate one or more interconnections. This can decrease insertion loss and advantageously increase the output power of the TWT. In one sample calculation, if the insertion loss can be reduced by 0.5 dB for a 100 Watt TWT, the output power of the TWT can be increased by about 11 Watts.

In addition, the disclosed techniques can be used to provide a relatively good impedance match between a TWT and a transmission line. This can reduce insertion losses and reflection losses, thereby increasing system RF output power. For example, a TWT can exhibit a combined impedance from the helix slow-wave structure and the electron beam of about 120 ohms. In a conventional TWT, the output of the TWT is coupled to the dielectric window, and is then coupled to a connector for a transmission line. A typical standard coaxial cable connector has a characteristic impedance in the range of about 50 ohms to 75 ohms. This connector and coaxial cable can then be coupled to an antenna, which typically has a complex impedance and couples the RF into free space, which has a characteristic impedance of about 377 ohms.

Impedance matching the approximately 120-ohm characteristic impedance from the TWT to the about 50-ohm characteristic impedance of a standard coaxial cable connector in a limited space can be challenging. Many conventional systems exhibit relatively large impedance mismatches, which lower the output power of a system. By contrast, embodiments can use rigid coaxial cables instead of dielectric windows and standard coaxial cables. For example, a rigid coaxial cable with a high-temperature dielectric can be selected with a relatively high characteristic impedance, such as 90 ohms, 100 ohms, and the like, for relatively good impedance matching to the TWT. This can advantageously reduce system losses and effectively increase the output power of the system.

Various embodiments have been described above. Although described with reference to these specific embodiments, the descriptions are intended to be illustrative and are not intended to be limiting. Various modifications and applications may occur to those skilled in the art without departing from the true spirit and scope of the invention as defined in the appended claims.

What is claimed is:

1. A traveling wave tube (TWT) for amplification of a radio frequency (RF) signal, the TWT comprising:

an envelope for maintaining a hermetically-sealed environment, the envelope includes at least an electron gun and a collector;

a helix-type slow-wave structure disposed within the envelope;

a rigid coaxial cable having an inner conductor, a solid conductive sheath, and a dielectric disposed between at least a portion of the inner conductor and the solid conductive sheath, a first end of the inner conductor is electrically coupled to an end of the helix-type slow-wave structure in the envelope; and a hermetically-sealed RF connector coupled to a second end of the inner conductor and a corresponding end of the solid conductor sheath; the envelope that maintains a sealed environment, wherein an interior of the envelope houses at least the helix-type slow-wave structure, and wherein at least portions of the solid sheaths for the rigid coaxial cable is disposed outside the sealed environment of the envelope and are hermetically sealed to a surface of the envelope.

2. The TWT as defined in claim 1, further comprising:

a second rigid coaxial cable having an inner conductor, a solid conductive sheath, and a dielectric disposed between at least a portion of the inner conductor and the solid conductive sheath, a first end of the inner conductor is electrically coupled to a second end of the helix-type slow-wave structure in the envelope; and a second hermetically-sealed RF connector coupled to a second end of the inner conductor and a corresponding end of the solid conductive sheath both of the second rigid coaxial cable.

3. The TWT as defined in claim 1, wherein the dielectric of the rigid coaxial cable comprises silicon dioxide ($SiO_2$).

4. The TWT as defined in claim 1, wherein the dielectric of the rigid coaxial cable comprises boron nitride.

5. The TWT as defined in claim 1, wherein the hermetically-sealed BY connector corresponds to a hermetic subminiature A (SMA) connector.

6. The TWT as defined in claim 1, wherein the hermetically-sealed RF connector corresponds to a hermetic TNC connector.

7. The TWT as defined in claim 1, wherein the hermetically-sealed RE connector corresponds to a hermetic SC connector.

8. The TWT as defined in claim 1, wherein the hermetically-sealed RE connector corresponds to a hermetic N connector.

9. A traveling wave tube (TWT) for amplification of a radio frequency (RE) signal, the TWT comprising:

a first rigid coaxial cable with a first end and a second end, the second end of the first rigid coaxial cable is coupled to a first hermetically-sealed RF connector so that the second end of the first rigid coaxial cable is hermetically-sealed;

a second rigid coaxial cable with a first end and a second end, the second end of the second rigid coaxial cable is coupled to the second hermetically-sealed RE connector so that the second end of the second rigid coaxial cable is hermetically-sealed;

a helix-type slow-wave structure with a first end and a second end, the first end is operatively coupled to an inner conductor of the first end of the first rigid coaxial cable, the second end is operatively coupled to an inner conductor of the first end of the second rigid coaxial cable; and an envelope that maintains a sealed environment, wherein an interior of the envelope houses at least the helix-type slow-wave structure, and wherein at least portions of sheaths for the first rigid coaxial cable and the second rigid coaxial cable are disposed outside the sealed environment of the envelope and are hermetically sealed to a surface of the envelope.

10. The TWT as defined in claim 9, wherein the sheathes of the first rigid coaxial cable and the second rigid coaxial cable are brazed to the surface of the envelope for hermetic sealing.

11. The TWT as defined in claim 9, wherein a dielectric of the rigid coaxial cable comprises silicon dioxide ($SiO_2$).

12. The TWT as defined in claim 9, wherein a dielectric of the rigid coaxial cable comprises boron nitride.

13. The TWT as defined in claim 9, wherein the hermetically-sealed RF connectors correspond to hermetic subminiature A (SMA) connectors.

14. The TWT as defined in claim 9, wherein the hermetically-sealed RF connectors correspond to hermetic TNC connectors.

15. The TWT as defined in claim 9, wherein the hermetically-sealed RF connectors correspond to hermetic SC connectors.

16. The TWT as defined in claim 9, wherein the hermetically-sealed RF connectors correspond to hermetic N connectors.

17. A method of forming a hermetically-sealed connection for traveling wave tube (TWT), the method comprising:

providing an envelope for the TWT, where the envelope comprises a helix-type slow wave structure, an electron gun, and at least one collector;

providing a rigid coaxial cable having a first end, a second end, an inner conductor, a sheath, and an insulator, where the second end is terminated by a hermetic RF connector;

electrically connecting the inner conductor of the first end of the rigid coaxial cable to an end of the helix; and joining the sheath of the rigid coaxial cable to at least a portion of the envelope to form the hermetic seal.

18. The method as defined in claim 17, further comprising:

using a vacuum furnace to bake out impurities from the envelope; and holding the hermetic RF connector at a lower temperature than the temperature of the vacuum furnace while baking out the impurities.

19. The method as defined in claim 17, wherein electrically connecting comprises welding.

20. The method as defined in claim 17, wherein joining comprises at least one of soldering, brazing, or welding.

21. The method as defined in claim 17, further comprising baking out impurities from the envelope while holding the hermetic RF connector at a lower temperature than the temperature of the baking.

* * * * *